US008261934B2

(12) United States Patent
Salciarini et al.

(10) Patent No.: US 8,261,934 B2
(45) Date of Patent: Sep. 11, 2012

(54) BOX WITH RETRACTABLE LID FOR COSMETIC OR TOILETRY PRODUCTS

(75) Inventors: Christian Salciarini, Couilly pont aux Dames (FR); Olivier Perrin, Chatillon (FR); Sylvie Legastelois, Asnieres sur Seine (FR)

(73) Assignee: Channel Parfums Beaute, Neuilly-sur-Seine (FR)

( * ) Notice: Subject to any disclaimer, the term of this patent is extended or adjusted under 35 U.S.C. 154(b) by 319 days.

(21) Appl. No.: 12/527,688

(22) PCT Filed: Feb. 15, 2008

(86) PCT No.: PCT/IB2008/001330

§ 371 (c)(1),
(2), (4) Date: Dec. 14, 2009

(87) PCT Pub. No.: WO2008/102273

PCT Pub. Date: Aug. 28, 2008

(65) Prior Publication Data

US 2010/0108676 A1 May 6, 2010

Related U.S. Application Data

(60) Provisional application No. 60/895,196, filed on Mar. 16, 2007.

(30) Foreign Application Priority Data

Feb. 19, 2007 (FR) ..... 07 53338

(51) Int. Cl.
*B65D 43/16* (2006.01)

(52) U.S. Cl. ..... 220/835; 206/581

(58) Field of Classification Search ..... 206/235, 206/581; 16/288; 220/826, 827, 263, 262, 220/260, 810, 834, 833; *B65D 51/04, 51/00*
See application file for complete search history.

(56) References Cited

U.S. PATENT DOCUMENTS 1,930,308 A 10/1933 Devlin (Continued)

FOREIGN PATENT DOCUMENTS

DE 642947 12/1996

(Continued)

OTHER PUBLICATIONS

International Search Report; Publication No. 2008/102273 A3; published Dec. 24, 2008.

*Primary Examiner* — Mickey Yu
*Assistant Examiner* — Robert J Hicks
(74) *Attorney, Agent, or Firm* — Hunton & Williams, LLP

(57) ABSTRACT

A box for cosmetic or toiletry products including a body having a bottom and a free edge and containing a cup containing a solid, paste or powder product, and a lid mounted to pivot on the body. The lid is connected to the body by at least one double hinge including an upper link articulated to the body and to the underside of the lid, and a lower link situated between the upper link and the bottom, more inclined than the first link relative to the bottom in the closed configuration of the lid, and articulated to the body and under the lid. In the closed configuration, the cover is retracted into the body and flush with the free edge, having at a distance from the double hinge an actuation area bearing at least indirectly against a bistable pushbutton elastically compressible toward the bottom of the body.

26 Claims, 7 Drawing Sheets

U.S. PATENT DOCUMENTS

Figure 1:
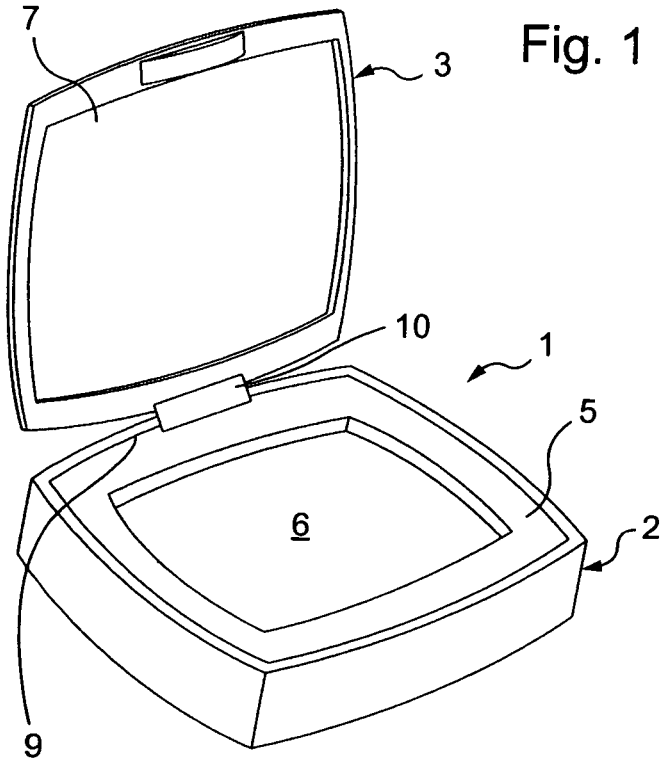

| | | | | |
|---|---|---|---|---|
| 2,010,521 | A * | 8/1935 | Kreisler | 220/259.2 |
| 2,054,004 | A | 9/1936 | Sandberg | |
| 2,134,828 | A * | 11/1938 | Kaplan et al. | 220/326 |
| 2,535,455 | A | 12/1950 | Reilly | |
| 5,205,431 | A * | 4/1993 | Zinnbauer | 220/326 |
| 5,638,839 | A * | 6/1997 | Montoli | 132/295 |
| 2003/0173369 | A1 * | 9/2003 | Nikolaus et al. | 220/830 |
| 2006/0096984 | A1 * | 5/2006 | Bandoh et al. | 220/254.5 |
| 2006/0138157 | A1 * | 6/2006 | Timm et al. | 220/839 |
| 2007/0278129 | A1 * | 12/2007 | Dieudonat et al. | 206/581 |

FOREIGN PATENT DOCUMENTS

| | | |
|---|---|---|
| FR | 2624359 | 12/1988 |

* cited by examiner

BOX WITH RETRACTABLE LID FOR COSMETIC OR TOILETRY PRODUCTS

CROSS-REFERENCE TO RELATED APPLICATIONS

This application is the U.S. National Phase Application of International Application No. PCT/IB2008/001330, filed Feb. 15, 2008, which claims the benefit of French Application No. FR 0753338, filed Feb. 19, 2007, and U.S. Provisional Application No. 60/895,196, filed Mar. 16, 2007, the disclosures of each of which is incorporated by reference in its entirety.

FIELD OF THE INVENTION

The invention concerns a box for a solid, paste or powder cosmetic or toiletry product such as a powder or a cream in particular.

BACKGROUND

Such boxes are conventionally globally flat (with a height significantly smaller than their other dimensions), with a shape that can be round, square (possibly with rounded corners), rectangular, polygonal, etc. It is generally composed of a body, typically formed by a bottom and a lateral wall, and a lid articulated to the lateral wall and having a rim which, in the closed configuration of the box, lines up with that wall, or even caps it. To ensure a large range of movement of the lid relative to the body, for example to enable the user to use a mirror on the interior face of the lid (this explains why this range of movement is typically greater than 90°, for example of the order of 120°, the articulation generally runs along the exterior surfaces of the lateral wall and the lid (usually its rim). The lid is generally maneuvered by acting on a projection on the lid at a distance from the articulation; this projection often cooperates with another projection provided on the lateral wall to hold, or even to lock, the lid onto the lateral wall in the closed configuration.

Also known are containers for cosmetic or toiletry products that include a body and a lid, as above, but in which the lid, instead of being articulated, is held in the closed configuration by a screwing action or even by a clipping action. However, such structures are hardly practicable for flat shapes, and so these containers are generally more bulky than the aforementioned boxes (they are generally referred to as "pots"). Furthermore, they have the drawback that the lid is therefore independent of the body, which obliges the user to put it down independently of the body if they wish to access the interior of the container; furthermore, opening (and closing) the container imply the use of both hands, with complex movements that can be awkward, especially if the user is not seated at a table or is in a public place. This explains the preference for boxes whose lid remains connected to the body at all times, for reasons of compactness and simplicity and reliability of use.

However, as just explained, boxes for cosmetic or toiletry products that include a lid connected at all times to the body of the box generally have projections, which has the drawback of constituting at least visual discontinuities relative to the body and the lid, which can compromise the overall esthetics. Another drawback of such projections is that they can snag on adjacent objects, or even the fabric inside a pocket or a handbag, and if this snagging is caused by projections for opening or locking the lid, it leads to unintentional opening of the box.

SUMMARY OF THE INVENTION

There is therefore a need for a box for cosmetic or toiletry products, including a lid connected at all times to a box body, that is both compact and simple and reliable to use, with as few projections as possible.

The invention therefore consists in a box for a cosmetic or toiletry product including a lid that is articulated to the box body without the articulation being visible from the outside, allowing a large range of movement of the lid on pivoting from a configuration retracted into the box body, without impeding the pivoting maneuver and with no exaggerated clearance between the edge of the lid and the free edge of the box body.

It must be noted here that merely moving the conventional articulation of such boxes (with a single pivot) inward cannot achieve the stated objective. In fact, the pivot would then be under the lid, so that at the start of pivoting of the lid its rear part (near the pivot) would initially move back toward the free edge, which would cause jamming; to avoid such jamming it would be necessary to provide a significant clearance between the free edge of the lid and the free edge of the body, but this clearance would compromise both the esthetics of the box and the protection of its content from the outside (and vice-versa).

The invention proposes a box for a solid, paste or powder cosmetic or toiletry product, including a body having a bottom and a free edge and containing a cup containing a solid, paste or powder product, and a lid mounted to pivot on the body between a configuration in which access to the product is possible and a closed configuration, characterized in that:

- the lid is connected to the body near an area of the free edge called the articulation area by means of at least one double hinge including an upper link articulated to the body about a first pivot and to the underside of the lid about a second pivot, and a lower link situated between the upper link and the bottom, more inclined than the first link relative to the bottom in the closed configuration of the lid, and articulated to the body about a third pivot and to the underside of the lid about a fourth pivot, these pivots being parallel and situated inside the body, near the articulation area, the second and fourth pivots being situated closer to this area and the lid than the first and third pivots, and in that
- in the closed configuration, the cover is retracted into the body, flush with the free edge, having at a distance from the articulation area an actuation area bearing at least indirectly against a bistable pushbutton elastically compressible toward the bottom of the body and having, relative to a position of maximum depression toward the bottom, two stable positions of which one is a retracted position in which the lid is flush with the free edge of the body and the other is an extended position in which the pushbutton pushes the actuation area beyond the free edge of the body, toward the outside of the body, so as to render at least the actuation area of the lid accessible to a user of the box.

Given the structure of the double hinge defined in this way, with two links that converge overall outward and toward the articulation area of the free edge, pivoting of the lid relative to the box body from the closed configuration is accompanied by a movement in translation of the second and fourth pivots upward and toward the center of the body. This has the advantage that the lid, at the beginning of its opening movement, is disengaged from the free edge not only close to the actuation area but also close to the articulation area, which thereafter allows a wide range of movement, even if the clearance with which the lid is retracted into the box body is small.

What is more, using the pushbutton guarantees that, by applying pressure to the actuation area of the lid when it is in the retracted configuration, given the bistable character of the pushbutton, there is obtained an outward disengagement of a portion of the lid, which enables a user to act on the lid to complete the pivoting movement at their convenience. Of course, this concept of a "portion" of the lid does not imply that the lid consists of several separate parts: it can in particular be in one piece.

Finally, because the lid is retracted into the box with no exaggerated clearance and the double hinge is entirely situated inside the box and the bistable pushbutton guarantees that the lid is pushed outward when required, the esthetics of the box are very tidy, since the lid has no portion projecting relative to the body and neither the articulation nor the opening/closing member projects.

The structure of the box is nevertheless compatible with great compactness, including in terms of thickness, whilst being very user-friendly and very reliable in use (in particular, the product contained is effectively protected from the outside environment, and vice versa).

There can of course be a number of similar double hinges offset along the articulation area, but it is advantageous, for reasons of simplicity, to provide only one; this can extend over only a small portion of the width of the box body, or instead extend along the greater portion of the articulation area.

According to one particularly advantageous feature of the invention, the cup is mobile between a depressed configuration in which it is set back relative to the free edge of the body and a configuration of use in which it is flush with the free edge of the body, the lid holding the cup in this depressed configuration against at least one elastic member when it is in the closed configuration. This has the advantage that, in the open configuration of use, the box resumes the usual look of a cup occupying substantially all the volume of the body, although this cup can retract, on closing the lid, to allow retraction of the lid.

The elastic force exerted on the cup tending to move the cup until it is flush with the free edge when the lid is open must of course not force out the actuation area of the lid even when the pushbutton is in the retracted configuration. This elastic force can in fact be provided by a compressible member of the pushbutton, or a member independent of the pushbutton, in which case its stiffness and location must be chosen so that it cannot, on its own, raise the cup and move the actuation area out of the body when the pushbutton is in the retracted configuration (this member can be one or more coil springs, or a leaf spring, or a flexible foam, for example in the form of a stud, etc., and the closer it is to the articulation area, the greater its stiffness can be: in fact, it is sufficient for this elastic member to be just able to raise the cup when the lid is open, given the existing friction).

Of course, the cup can instead be fixed relative to the body, at a level below the free edge of the body just sufficient to allow retraction of the lid flush with this free edge in the closed configuration.

According to preferred and advantageously combined features:

- the cup is further subject to the outward thrust of the pushbutton so that the actuation area of the lid bears on the pushbutton via the cup; a particular result of this is that the cup effectively conceals the pushbutton when the lid is open,
- the cup is reversibly engaged in a frame mobile within a given range of movement relative to the bottom, this frame being subjected to the outward thrust of the pushbutton; as a result, the cup can be detached (for example replaced) without having to modify the internal structure of the box, or to size the cup very accurately relative to the box body; the reversible interengagement of the cup in the frame can be achieved by clipping together complementary portions of the frame and the cup, for example; of course, the cup can alternatively also be permanently fastened to a reinforcing frame,
- the frame is held in a maximum elevation configuration relative to the bottom by relative clipping between portions of the frame and the bottom, with a clearance corresponding to the required travel of the frame relative to the bottom, which avoids the frame escaping from the body of the box unintentionally; this clipping with clearance can be obtained by means of feet fastened to the bottom of the body (or of the frame) around which lugs of the frame (or of the body) are clipped whilst being able to slide along these feet, for example,
- the cup (and where applicable the frame in which it is engaged) is subjected to the thrust of at least two identical elastic members distributed substantially symmetrically with respect to a plane of symmetry of the articulation area, which ensures a good distribution of forces and encourages easy movement, even with a small clearance enabling the aforementioned retention by friction,
- there is only one pushbutton which is situated substantially in a plane of symmetry of the articulation area, which also helps to encourage easy movement around the pivots,
- the body has the overall shape of a rectangle or a square, the cup being subjected at least indirectly (via the frame when there is one) to the thrust of four elastic members disposed substantially in the corners, which corresponds to a visually pleasing shape, whilst ensuring a good distribution of forces applied to the frame,
- the body includes a bottom and a lateral wall substantially parallel to the direction of movement of the pushbutton; this guarantees that not only the edge of the lid but also the edge of the frame moves easily, since the internal section of the box is therefore constant.

According to another particularly advantageous feature, the body and the lid conjointly include at least one holding device adapted to hold the lid in the closed position; this helps to make the closure of the box more reliable in that it reduces the risk of unintentional opening, for example because of impacts. This holding device can include complementary attachment members (using respective retaining members), but can also include passive members, such as simple magnets, adapted to be moved apart when the pushbutton is moved to the extended configuration, or can be formed of one or more deformable elastic members.

Accordingly:

- the holding device preferably includes complementary attachment members,
- the complementary attachment members preferably include claws carried by the body, globally oriented toward the lid and mounted to slide perpendicularly to the bottom between an upper configuration in which the claws are apart and a lower configuration in which the claws are held close together, together with a protuberance carried by the lid adapted to be engaged between the claws in the closed configuration of the lid, which corresponds to effective locking, the claws are advantageously attached to an abutment against which the protuberance presses to cause the claws to penetrate between ramps adapted to force them toward each other, which ensures that the movement of closing of the lid is sufficient to guarantee locking, these complementary attachment members are preferably carried by the bistable pushbutton and the lid, respectively; alternatively, these members are disposed at a distance from the pushbutton so as to disassociate the pushbutton and attachment functions, alternatively, the holding device is formed by at least one elastically deformable member advantageously capable of holding the lid in a completely open configuration (in which case this holding device is bistable); this elastically deformable device is advantageously disposed between some of the pivots of the double hinge.

According to other preferred features of the invention, advantageously combined:

the links are rods the ends of which are curved to enter bores defining the pivots; this is a very easy way, using simple rods conformed appropriately, to provide the required double hinge, without risk of these links impeding each other because it is possible to dispose these rods on each side of the bores defining these pivots, alternatively, the links are rigid plates the ends of which are rolled to define housings defining the pivots, which has the advantage of guaranteeing that these housings are parallel, at the same time as imparting good stiffness in torsion to the double hinge, the links are substantially the same length, which contributes to a good distribution of forces while simplifying the fabrication of these links, which can thus be identical, if required, the fourth pivot is closer to the articulation area than the second pivot, which helps to prevent the links crossing over during the pivoting movement, even if the latter exceeds 90°, the upper link has an overall inclination of less than 20° (preferably of the order of 10° relative to the median plane of the lid in the closed configuration, which enables lifting of the lid (relative to the articulation area) as soon as the pivoting movement of the lid begins, the lower link has an overall inclination between 20° and 50° (preferably of the order of 40° relative to the median plane of the lid in the closed configuration, which allows a large range of movement even with links of moderate length, the pushbutton includes two bearing surfaces mobile relative to each other and being urged toward each other by at least one spring, one of the bearing surfaces being fastened to a closed heart-shaped guide track, globally situated in a plane perpendicular to the median plane of the bottom and the other bearing surface having a follower finger intended to follow this guide track during relative movements of this bearing surface, alternatively, the pushbutton includes two bearing surfaces formed of two rings mobile relative to each other in rotation and in translation and being urged toward each other by at least one spring, one ring having radial projections pressed against an annular track fastened to the other ring, this annular track being sawtooth-shaped with hollows having at least two different depths, there is only one pushbutton, which corresponds to a simple structure, as well as enabling accurate location of where to apply pressure to open the lid; this single pushbutton is preferably situated opposite the double hinge, of which there is also preferably only one, relative to a central area of the box, the first and third pivots (fastened to the body) are carried by a projection on the bottom of the box body, which has the advantage of not loading the wall of the body and therefore, in particular, of imparting a constant thickness thereto.

It is equally advantageous if the body has the overall shape of a rectangle or a square (or even a polygon with an even number of sides), the double hinge and the pushbutton, of which there is only one each, being disposed substantially in the middle of two opposite sides, which corresponds to a compact and elegant shape at the same time as enabling easy movement. One of a number of variants is for this body to be any shape, in particular a circular or oval shape, having a plane of symmetry, there being only one double hinge and one pushbutton, both situated in this plane of symmetry.

LIST OF FIGURES

Figure 2:
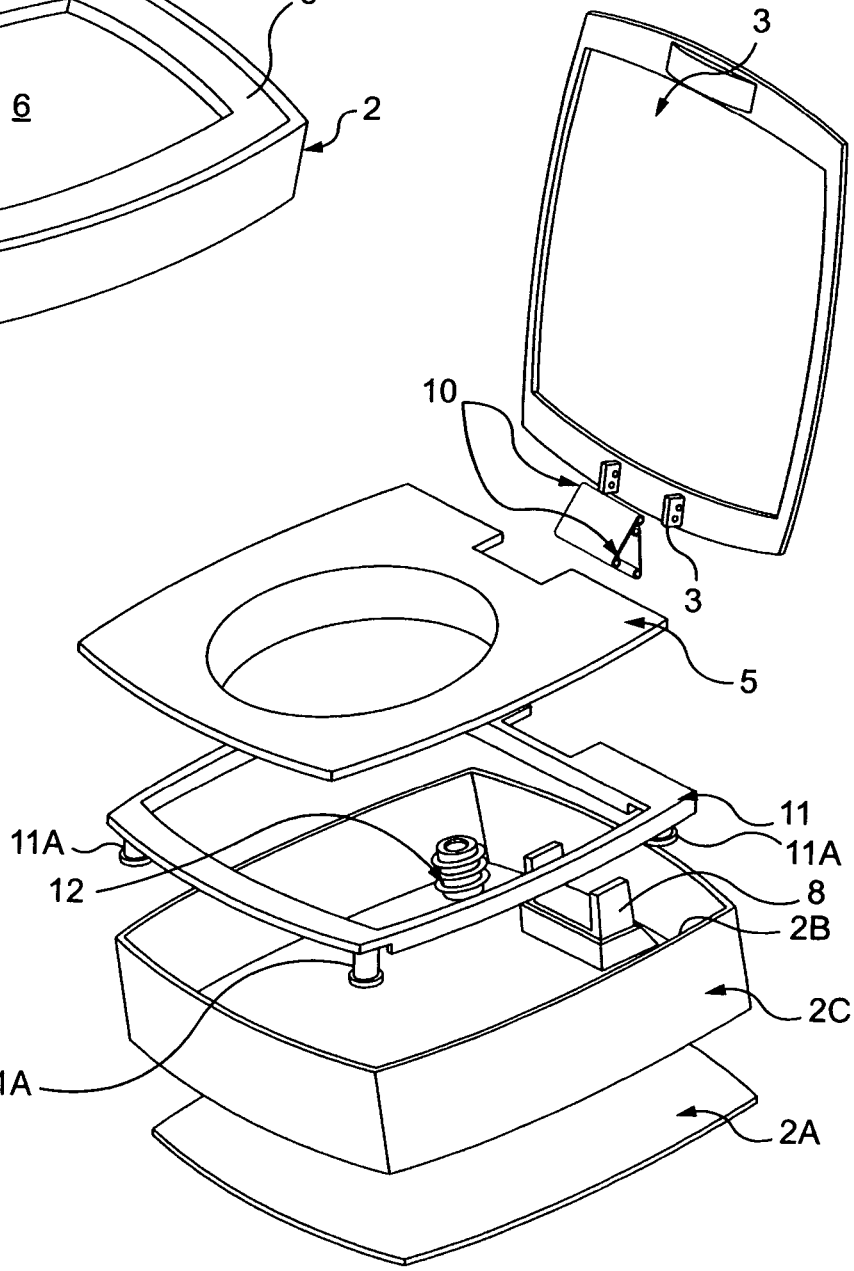
Figure 3:
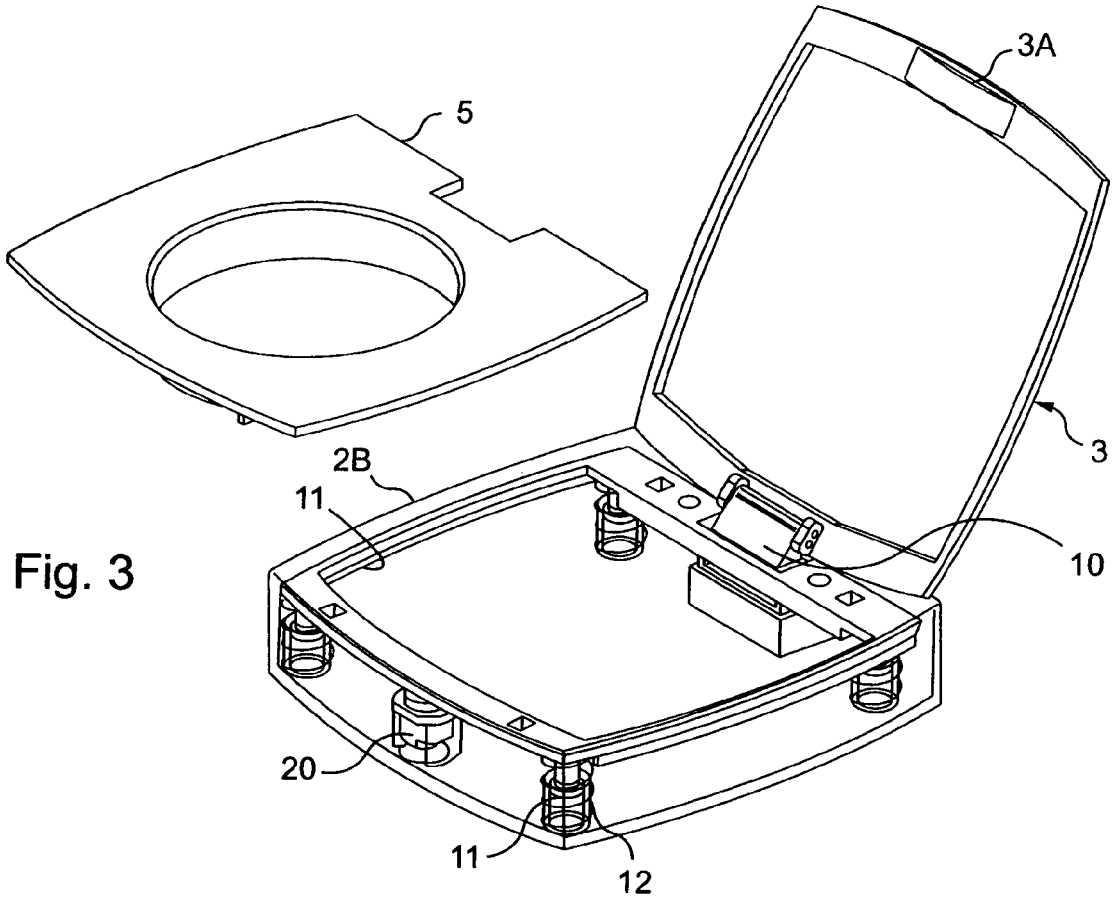
Figure 4:
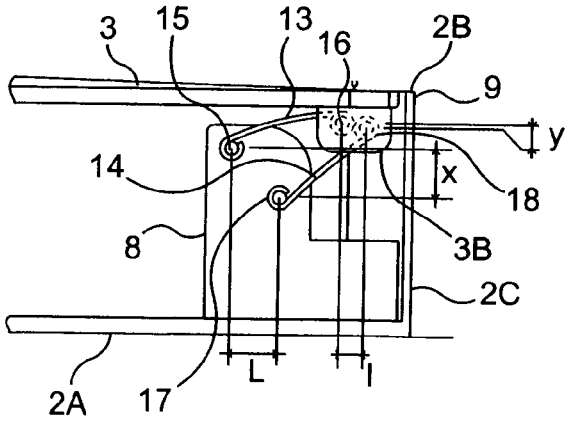
Figure 5:
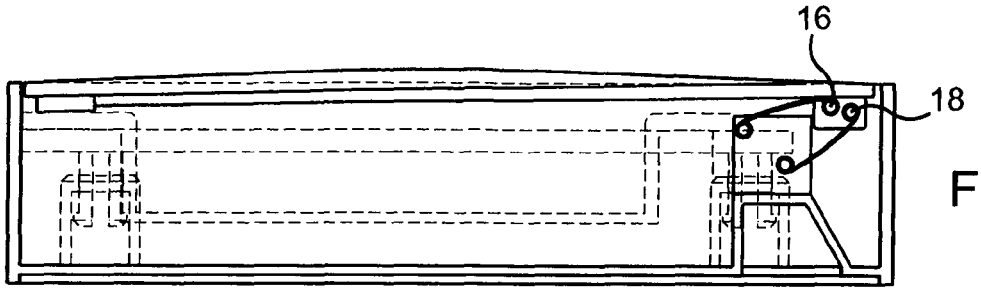
Figure 6:
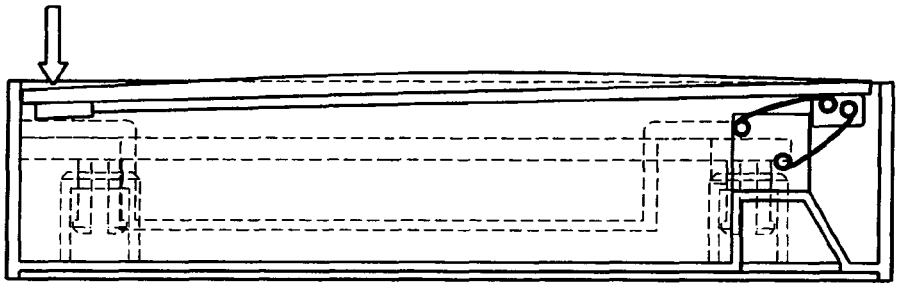
Figure 7:
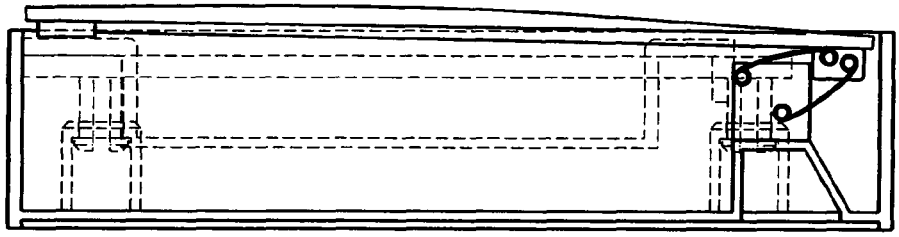
Figure 8:
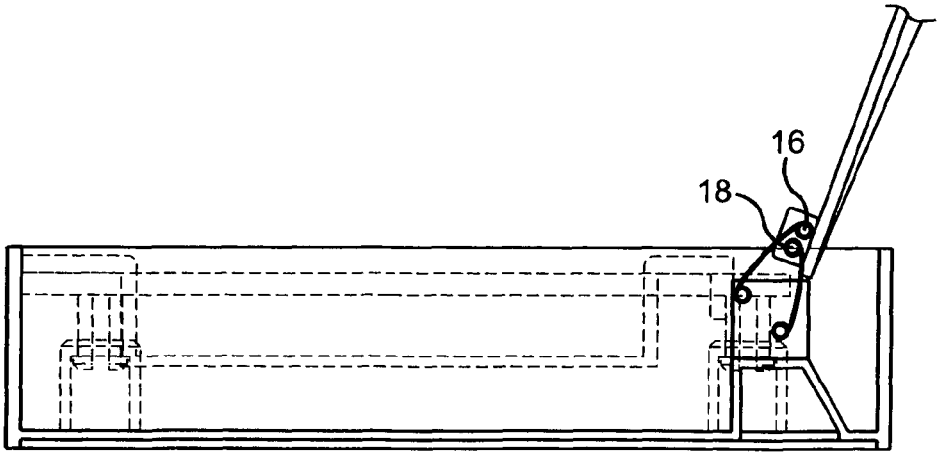
Figure 11:
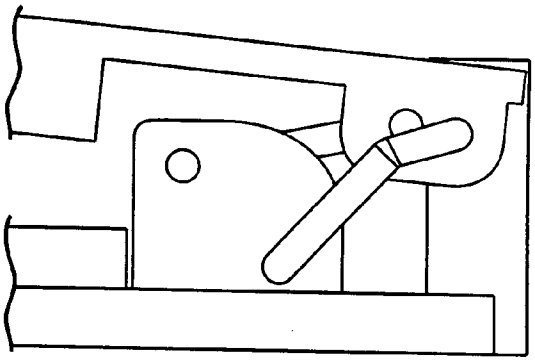
Figure 12:
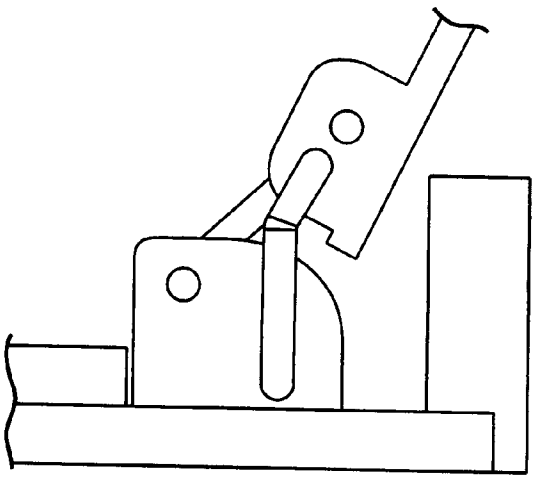
Figure 10:
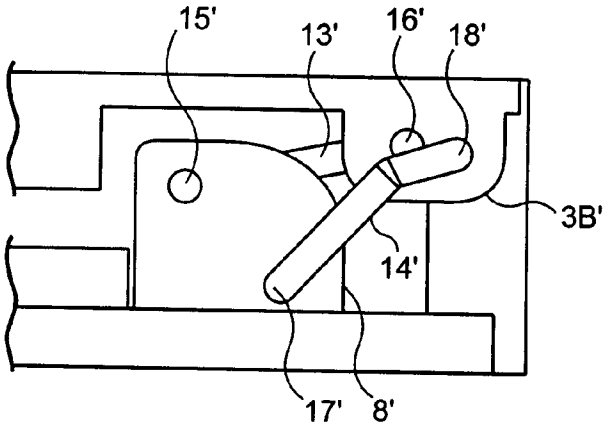
Figure 9:
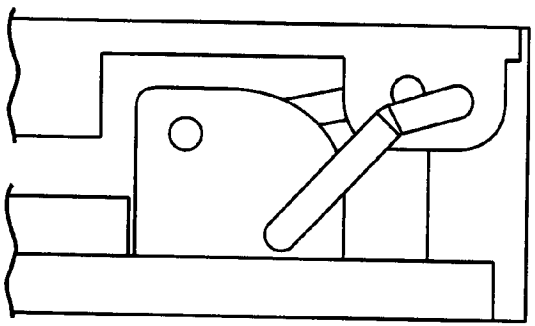
Figure 15:
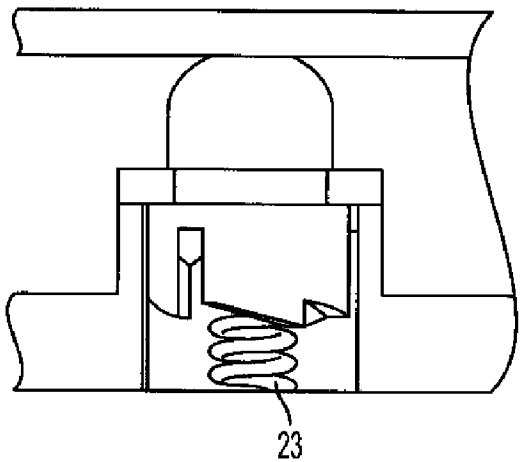
Figure 14:
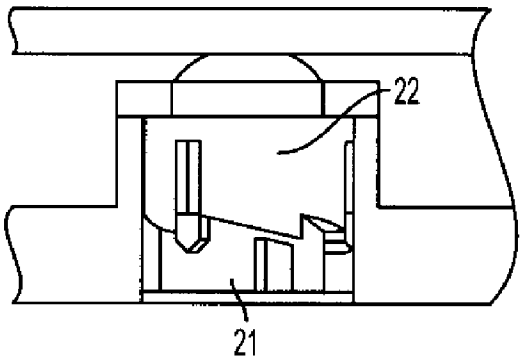
Figure 13:
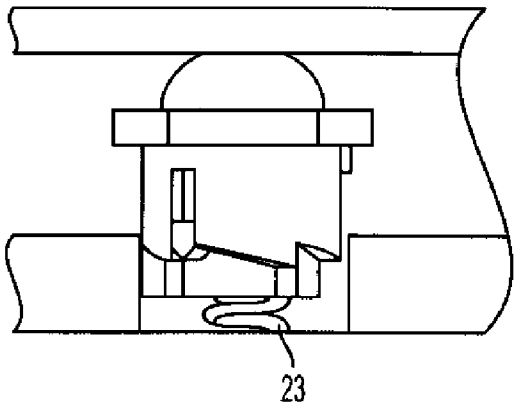
Figure 18:
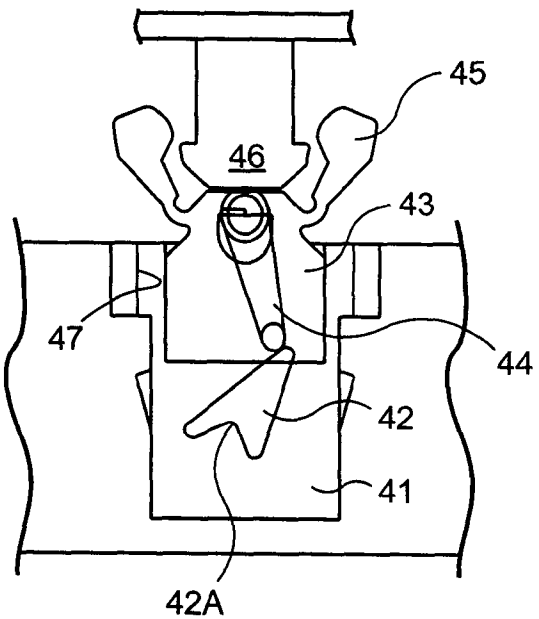
Figure 17:
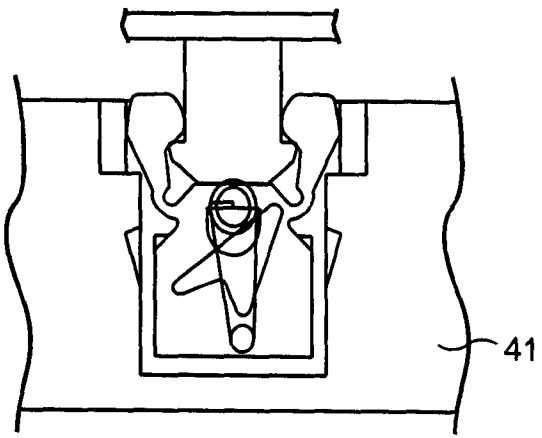
Figure 16:
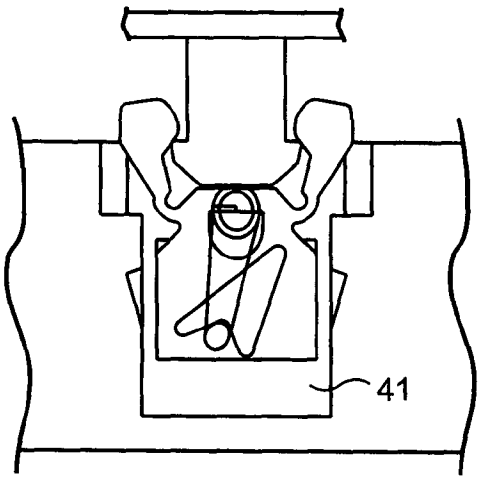
Figure 19:
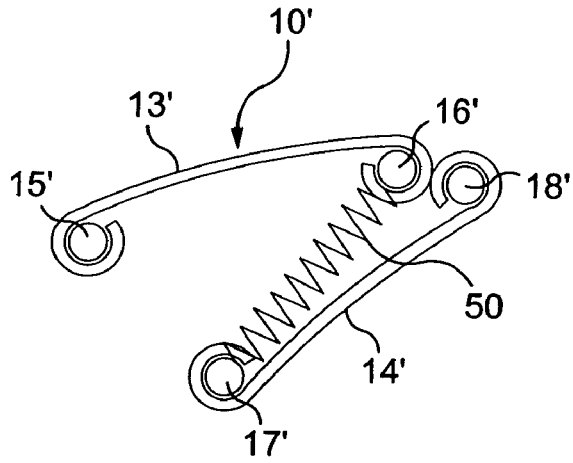
Figure 20:
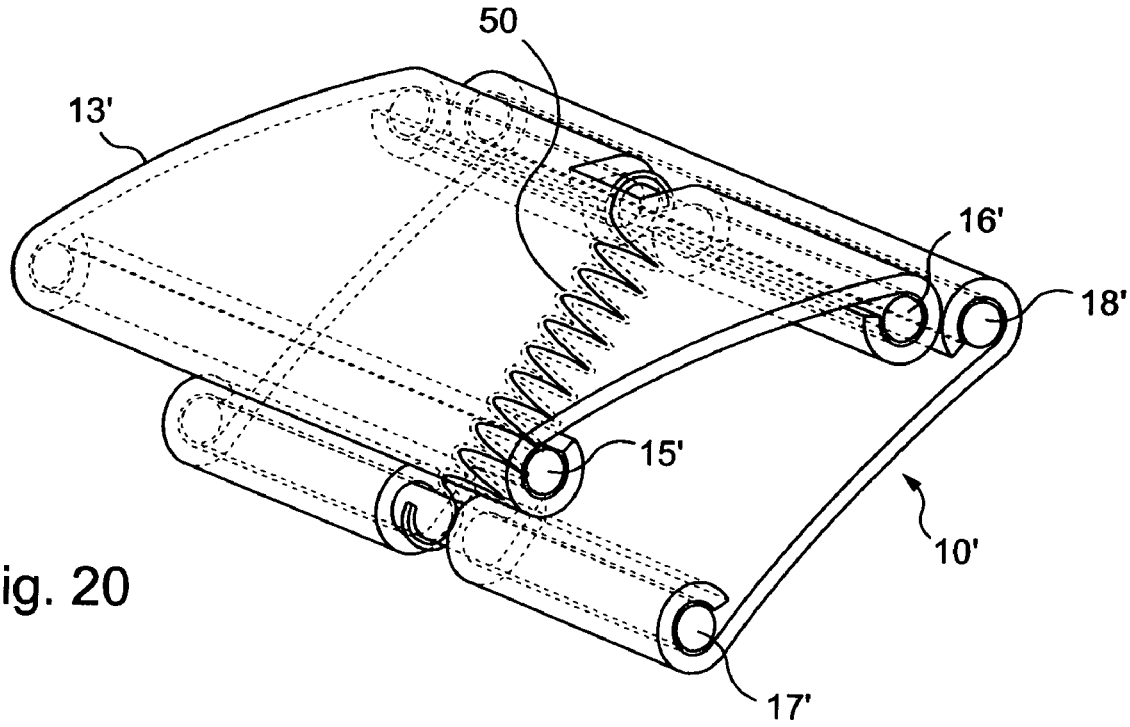

Objects, features and advantages of the invention emerge from the following description given by way of nonlimiting and illustrative example with reference to the appended drawings, in which:

FIG. 1 is a perspective view of a box according to the invention,

FIG. 2 is an exploded perspective view thereof without the lid closing/opening members, FIG. 3 is a perspective view thereof without the removable cup, FIG. 4 is a view in section of the articulation between the lid and the box body, FIG. 5 is a view in section of the box in the closed configuration, FIG. 6 is a similar view thereof after depression of the actuation area of the lid over a limited travel, FIG. 7 is a similar view thereof at the start of disengagement of the lid from the box, FIG. 8 is a similar view thereof in the open configuration, FIG. 9 is a detail view showing a different embodiment of the articulation from FIG. 4 in its configuration corresponding to FIG. 5, FIG. 10 is a detail view thereof corresponding to FIG. 6, FIG. 11 is a detail view thereof corresponding to FIG. 7, FIG. 12 is a detail view thereof corresponding to FIG. 8, FIG. 13 is a detail view showing the bistable pushbutton bearing on the lid in the closed configuration, corresponding to FIG. 5, FIG. 14 is a view thereof corresponding to FIG. 6, FIG. 15 is a view thereof corresponding to FIG. 7, FIG. 16 is a diagram in section of a different embodiment of the pushbutton, including attachment elements, in the configuration corresponding to FIG. 5, FIG. 17 is a view thereof corresponding to FIG. 6, FIG. 18 is a view thereof corresponding to FIG. 7, FIG. 19 is a diagram in section of a different embodiment of the double hinge including a device for holding the lid in the closed position formed of an elastically deformable member, the lid being in the FIG. 5 configuration, and FIG. 20 is a perspective view thereof.

DETAILED DESCRIPTION OF PREFERRED EMBODIMENTS

FIG. 1 represents diagrammatically a box for solid, paste or powder cosmetic or toiletry products conforming to the invention, while FIG. 2 is an exploded view thereof (minus some of the maneuvering members).

This box, designated as a whole by the reference 1, includes a body 2 with a bottom 2A and a free edge 2B, as well as a lid 3 mounted to pivot on the body between a configuration in which access to the product is possible (this is the case in FIG. 1) and a closed configuration in which the lid blocks access to the interior of the box. The lid is therefore connected permanently to the body.

In this body is disposed a cup 5, commonly called a "sifter", containing the product in question, here designated by the reference 6, sometimes called a "cake" if it is solid. This product can be a powder, but also a make-up element, etc.

In the example shown, the free edge 2B is defined by the upper edge of a lateral wall 2C connected by its lower edge to the bottom 2A. Furthermore, this body has a globally rectangular shape, to be more precise a substantially square shape, with curved sides.

To be more precise, as seen in FIG. 2, in the example shown, the bottom 2A is an element attached to a lateral wall; the bottom and this lateral wall can therefore be made from different materials, if required, and have different or even contrasting appearances.

In FIG. 1, the lid includes along its internal surface a mirror 7 that can assist a user to apply the product 6 to their face.

This lid is articulated to the body by means of a double hinge designated by the general reference 10; it will be described in more detail with reference to FIG. 4 and FIGS. 9 to 11.

This double hinge connects an underlying area 3B of the lid that is situated substantially in the middle of one of its sides to an area of the body 8 here consisting of a base fixed to the bottom 2A, close to the middle of one side of the body.

As will become clear, the lid appears to be articulated in an articulation area 9 (the double hinge here being situated in the middle of one side of the free edge) without the pivots really being situated in this area of the free edge.

The cup or sifter 5 is advantageously a removable part, engaged in a frame 11, mounted on at least one elastic member, here springs (one of which is represented under the reference 12), which urges it toward the exterior of the body. This frame advantageously includes feet 11A which, by abutting against the bottom against the action of the springs, define a position of maximum retraction of this frame. The cup is advantageously reversibly connected to the frame so as to remain fastened to it in use, whilst being temporarily detachable from it if required (for example for maintenance or replacement of the product). This reversible fixing is effected by relative clipping between complementary elements provided on the cup and the frame, for example. In a different embodiment that is not shown, the cup is permanently fastened to its frame (which serves to stiffen the cup), or even has no frame, if the cup is sufficiently rigid in itself.

As seen in FIG. 3, which shows the cup outside the box, the frame 11 is set back (i.e. lower) relative to the free edge 2B of the body, which enables the cup 5, once engaged in the frame 11, to be flush with the free edge 2B (here the setting back is exaggerated relative to the thickness of the cup for reasons of legibility). This frame (with the cup) can furthermore move back toward the bottom of the box body, so that, in the closed configuration, the lid can be flush with this free edge, thus being retracted inside the body.

In fact, the cup is advantageously mobile between a depressed configuration in which it is set back relative to the free edge of the body and a configuration of use in which it is flush with this free edge, the lid holding the cup in this depressed configuration against the action of the elastic members 12 when it is in the closed configuration.

Complementing what is seen in FIG. 2, FIG. 3 represents a bistable pushbutton 20 that is elastically compressible towards the bottom of the body, having two stable positions relative to a position of maximum depression toward the bottom, comprising a retracted position in which the lid is flush with the free edge and an extended position in which this pushbutton pushes the actuation area beyond the free edge of the body (thus above it and outside the body) so as to make at least this area of the lid accessible to a user. This pushbutton will be described in more detail with reference to FIGS. 13 to 15 (and a different embodiment will be described with reference to FIGS. 16 to 18).

The pushbutton is maneuvered to open the lid by application of pressure to an actuation area 3A of the lid situated at a distance from the articulation area, advantageously opposite the latter area relative to the location of the product, vertically in line with the pushbutton.

It is clear from FIGS. 2 and 3 that the double hinge passes through the cup and the frame whereas it is only indirectly (via the cup and the frame) that the lid bears against the pushbutton 20.

In fact, here pressure on the actuation area is transmitted to the pushbutton via the cup which, where applicable with the frame, is disposed between this actuation area and the pushbutton. In a different embodiment that is not shown, if the cup is fixed relative to the body (set back relative to the free edge so as to enable retraction of the lid), cooperation between the pushbutton and the actuation area of the lid is advantageously direct, by virtue of a notch formed in the lid.

As is clear from FIG. 4, representing in detail a section of the double hinge 10, the latter includes an upper link 13 and a lower link 14 situated between the level of the upper link and the bottom and more inclined than the upper link relative to the bottom in the closed configuration of the lid (which is the configuration represented in FIG. 4). These links cooperate with first, second, third and fourth pivots 15 to 18. These pivots are parallel to each other and situated inside the body, close to the articulation area 9. The pivots of articulation to the lid (the second and fourth pivots) are situated closer to this area 9 than the pivots of articulation to the body (the first and third pivots). In other words, the links have general directions which, overall, converge approximately in the direction of the articulation area (and therefore toward the right and upward in FIG. 4).

To be more precise, the upper link 13 is articulated to the body (portion 8) about the first pivot 15 and to the underside of the lid 3 (portion 3B) about the second pivot 16, and the lower link 14 is articulated to the body about the third pivot 17 and to the underside of the lid about the fourth pivot 1B. It is seen that, in the example represented, the pivot 15 is situated above the pivot 17 by a distance denoted "x", that the pivot 16 is situated above the pivot 18 by a distance "y" much shorter than the distance x, and that the pivot 17 is offset to the right of the pivot 15 by a distance "L" significantly greater than the distance "l" by which the pivot 18 is offset to the right relative to the pivot 16. It is clear that, since the pivots 15 and 17 are fixed relative to the body whereas the pivots 16 and 18 are fixed relative to the lid, the distances "x" and "L" are constant while the distances "y" and "l" vary during movements of the lid.

In FIG. 4, the links are rigid sheets the ends of which are rolled so as to define housings defining the first, second, third and fourth pivots. However, in a different embodiment represented in FIGS. 9 to 12, the links are rods with curved ends so as to be parallel and to be able to penetrate into bores defining the pivots (advantageously disposed on respective opposite sides of the portions 8 and 3B). In these FIGS. 9 to 12, elements analogous to those of FIG. 4 are designated by references deduced from those of that FIG. 4 by adding the "prime" suffix.

It can be seen that the links have substantially the same length.

The upper link advantageously has, relative to the median plane of the bottom, a small inclination, of at most 20°, preferably of the order of 10°, whereas the lower link advantageously has, relative to this median plane of the bottom, a greater inclination, between 20° and 50°, preferably of the order of 40°.

The frame is advantageously retained in the body (without leaving it) with a small clearance with the lateral wall 2C of the body. This retention is advantageously achieved by clipping with clearance between complementary studs with which the underside of the frame and the bottom of the body are provided (these studs can include the feet 11A on the frame).

It is clear from FIG. 3 that, in the example considered, the cup is subjected to the thrust of at least two identical springs distributed substantially symmetrically relative to a plane of symmetry (a vertical plane intersecting the double hinge, for example the plane of FIG. 4).

There is preferably only one pushbutton, here in the middle of the side opposite that with the double articulation hinge in the middle, but it is clear that there can be several of them, for example disposed at ⅓ and ⅔ of the length of the side opposite the side including the articulation area. Similarly, in a different embodiment that is not shown, there can be several double hinges, for example two of them, offset lengthwise of the articulation area.

Here the double hinge is substantially shorter than the sides of the body (for example not more than half, typically between ¼ and ½ of the length of the sides). In fact, one double hinge extending over about one quarter of the length of this side (or even less) is sufficient to ensure accurate pivoting without twisting.

The frame is advantageously subject to the thrust of a plurality of springs (here in each corner of the body), which minimizes the risk of warping of the frame and therefore of it jamming.

These elastic members are in practice just sufficient to raise the frame and its cup when the pushbutton has moved the actuation area out of the body, so as to enable retraction of the lid into the body when required.

The lateral wall is advantageously parallel at all points to the direction of movement of the pushbutton (i.e. upward), which means that the internal volume delimited by this wall is of constant horizontal section.

FIGS. 5 to 8 represent four phases in the opening of a box such as the one that has just been described, FIGS. 9 to 12 on the one hand and FIGS. 13 to 15 on the other hand representing the corresponding configurations of the hinge 10' and the pushbutton 20.

In FIG. 5, the lid is flush with the free edge of the box body, the hinge 10' (FIG. 9) is in a configuration similar to that described with reference to FIG. 4, and the pushbutton is in a retracted configuration (FIG. 13).

When a user requires access to the product, they apply to the actuation portion 3A of the lid a thrust toward the bottom of the body (FIG. 6). This causes very slight rotation of the double hinge in the anticlockwise direction as seen in FIG. 10, while the pushbutton is moved to its maximum depression configuration, or close to the latter (FIG. 14); this is an unstable configuration which, when the pressure on the lid is removed, results in the pushbutton spontaneously moving to its expanded configuration (FIG. 15); as a result the lid pivots slightly upward, as shown in FIG. 7 (the double hinge hardly changes configuration, see FIG. 11), but this is sufficient for the user to be able to grasp the lid and move it to a convenient open configuration (FIGS. 8 and 12).

Note that, between the FIGS. 5 and 8 configurations, the fixed pivots 15 and 17 define a plane inclined at substantially 45° relative to the bottom, being oriented upward and toward the left, while the mobile pivots 16 and 18, which define a plane which, as seen in FIG. 5, is substantially parallel to the bottom, being very slightly inclined upward and to the left, but which pivots, in the same direction as the plane of the lid, to a configuration in which, as seen in FIG. 8, this plane of the pivots 16 and 18 intersects the plane of the fixed pivots 15 and 17 between those fixed pivots.

In a different embodiment that is not shown, a spring is associated with the double hinge, acting in traction between the pivots 15 and 18, for example, so as to apply a torque to the lid to move it spontaneously to its maximum open configuration (without being sufficient to prevent the lid from remaining in its closed configuration when required). In a further embodiment represented in FIGS. 19 and 20, an elastically deformable member can also be provided to help to hold the lid in one or the other of its extreme angular positions (this is explained hereinafter).

To close the lid, the user folds down the lid and applies sufficient pressure to it to cause the pushbutton to be depressed into its maximum depression configuration (or close to it), so that it then goes to its retracted configuration in which it allows the lid to be flush with the free edge, without exerting on it any force tending to expel it from its retracted configuration.

It is clear from FIGS. 13 to 15 that the pushbutton is of a type including two bearing surfaces formed by two rings 21 and 22 mobile relative to each other in rotation and in translation and being pressed together by at least one spring 23. The ring 21, mobile relative to the bottom, includes radial projections pressed axially against an annular track fastened to the other ring 22, which is fastened to the bottom, this downwardly oriented track being of sawtooth shape with hollows (facing upward) of one or the other of two different heights. Clearly, depending on whether the radial projections are aligned with the shallow recesses or the deep recesses, the pushbutton assumes one or the other of two configurations, according to whether the mobile ring 21 has been able to rise into the fixed ring 22 or not.

This type of pushbutton is relatively close to the principle of the pushbutton on ballpoint pens.

FIGS. 16 to 18 represent a different embodiment of the pushbutton.

This pushbutton 40 has two parts mobile relative to each other and loaded relative to each other by at least one spring. The part 41 is fastened to a heart-shaped closed guide track (here surrounding an arrowhead-shaped projecting portion 42), which is globally situated in a plane perpendicular to the middle plane of the bottom, i.e. vertical. The other part 43 has a follower finger 44 intended to follow this guide track during relative movement between these bearing surfaces. The parts have a relative movement in rotation or the follower finger has a range of movement in pivoting (as shown). When the follower finger is held in the trough 42A (lower portion) of the path, the pushbutton is retracted, whereas, when the follower finger is in the upper part of the path, the pushbutton is in the extended configuration.

It is furthermore clear from FIGS. 16 to 18 that, in the embodiment represented therein, the body and the lid have complementary attachment members for holding the lid in the closed position.

To be more precise, here the body includes claws 45 carried by the body, globally oriented toward the lid and mounted to slide perpendicularly to the bottom between an upper configuration in which these claws are separated and a lower configuration in which these claws are held close together. Moreover, the lid includes a protuberance 46 adapted to be engaged between the claws in the closed configuration of the lid.

In the example shown, the attachment claws are fastened to the mobile part of the pushbutton, i.e. the pushbutton is of an integrated attachment (or locking) type. It is nevertheless clear that the functions of the pushbutton and of locking could instead be divided between distinct elements.

The mobile part to which the claws are fastened advantageously includes an abutment, here a central abutment, against which the protuberance bears to cause penetration of the claws between ramps 47 adapted to force the claws toward each other.

Boxes according to the invention can of course have many other shapes, in particular polygonal or even round or oval shapes.

FIGS. 19 and 20 show one embodiment of a device for holding the lid in the closed position.

Here this device is integrated into the double hinge 10' (in a situation where, as in the example from FIGS. 1 to 3, the latter includes two links 13' and 14' formed of two rigid curved plates), for example consisting of a simple coil spring 50, operating in tension between the pivots 17' and 16', i.e. between the pivots which, situated at opposite corners of the quadrilateral defined in section (in FIG. 19) by the four pivots, define a plane oriented upward and toward the right. This spring therefore tends to hold close together the fixed pivot of the lower link and the mobile pivot of the upper link. In the completely closed configuration, such as that of FIG. 5, this traction tends to hold the lid closed. Nevertheless, in the configuration of FIG. 8 in which the plane of the pivots 16 and 18 intersects the plane of the fixed pivots between the latter, this traction applied by the spring tends to hold the lid in this open configuration. In this example, the spring 50 thus constitutes a device for holding the lid in the closed position, but also in the completely open configuration, thus constituting a bistable element.

By way of nonlimiting example:

the body of the box is of an ABS type plastic material, covered by a protective varnish, with a length of 70 mm and a width of 70 mm (its section is therefore substantially square) and a depth of 15 mm, the bottom having a thickness of 2 mm and its wall a thickness of 1.5 mm, the studs 11 having a diameter of 6 mm, the pushbutton has a depression travel of 1.2 mm relative to its retracted configuration and an extension travel of 2.2 mm between the extended configuration and this retracted configuration, the cup is of a PP type plastic material and has a thickness of 1.5 mm, the double hinge extends about 14 mm along the articulation area, the upper link being of aluminum alloy, advantageously anodized (which can give it a gilded appearance; alternatively it can also be of stainless steel, in particular; such steel links can be lacquered so as to impart a required color to them) and having a length of 7 mm between the two pivots, whereas the lower link is likewise of aluminum alloy (or stainless steel) and has a length of 6.83 mm between the pivots (and is therefore advantageously slightly shorter than the upper link), the distances defined in FIG. 4 being, respectively:

l=1.493 mm,

L=3 mm, x=3 mm (x and L are therefore equal here), and y=0.301 mm, the upper link, visible when the lid is open, advantageously carries a logo, for example identifying the source of the product, the lid is of an appropriate plastic material, advantageously varnished, preferably with a mirror on its inside face (alternatively it is of a plastic material fitted with an aluminum alloy, anodized aluminum or iron alloy embellisher, the mirror and the lid being formed of the same material, where appropriate, and has a thickness of 1.5 mm.

The invention claimed is:

1. A container for a solid, paste or powder cosmetic or toiletry product, including:

a body comprising a bottom and a free edge and including a cup comprising a solid, paste or powder product, and a lid mounted on the body and pivotable between a configuration allowing access to the product and a closed configuration, wherein:

the lid is connected to the body near an articulation area by at least one double hinge including:

an upper link articulated to the body about a first pivot and to the underside of the lid about a second pivot, and a lower link situated between the upper link and the bottom, wherein:

said lower link is more inclined than the first link relative to the bottom in the closed configuration, and said lower link is articulated to the body about a third pivot and is articulated to the underside of the lid about a fourth pivot, further wherein said pivots are parallel and situated inside the body near the articulation area, and the second and fourth pivots are located closer to the articulation area and the lid than the first and third pivots, and in the closed configuration, the lid is retracted into the body, flush with the free edge, said lid comprising an actuation area at a distance from the articulation area, further wherein:

said actuation area bears at least indirectly against a bistable pushbutton that is elastically compressible toward the bottom of the body, and said bistable pushbutton includes, relative to a position of maximum depression toward the bottom, two stable positions of which one is a retracted position wherein the lid is flush with the free edge of the body and the other is an extended position wherein the pushbutton supports the actuation area beyond the free edge, toward the outside of the body, such that at least the actuation area of the lid is accessible to a user of the container.

2. The container of claim 1, wherein the cup is movable between a depressed configuration wherein it is depressed relative to the free edge of the body and a configuration of use wherein it is flush with the free edge of the body, wherein said lid holds the cup in said depressed configuration against at least one elastic member when said lid is in the closed configuration.

3. The container of claim 2, wherein the cup is subjectable to the outward thrust of the pushbutton so that the actuation area of the lid bears on the pushbutton via the cup.

4. The container of claim 2, wherein the cup is reversibly engaged in a frame movable within a range of movement relative to the bottom, and said frame is subjectable to the outward thrust of the pushbutton.

5. The container of claim 4, wherein the frame is held in a maximum elevation configuration relative to the bottom by clipping between portions of the frame and the bottom, with a clearance corresponding to travel of the frame relative to the bottom.

6. The container of claim 2, wherein the cup is subjectable to the thrust of at least two identical elastic members distributed substantially symmetrically with respect to a plane of symmetry of the articulation area.

7. The container of claim 2, wherein said pushbutton is situated substantially in a plane of symmetry of the articulation area.

8. The container of claim 2, wherein the body has a overall shape of a rectangle or a square, and the cup is subjectable, at least indirectly, to the thrust of four elastic members disposed substantially in the corners of said body.

9. The container of claim 2, wherein said body further comprises a lateral wall that is substantially parallel to the direction of movement of the pushbutton.

10. The container of claim 1, wherein the body and the lid include a device for holding the lid in the closed configuration.

11. The container of claim 10, wherein the holding device includes complementary attachment members adapted to cooperate in the closed configuration of the lid.

12. The container of claim 11, wherein the complementary attachment members comprise claws carried by the body, globally oriented toward the lid and slideable perpendicularly to the bottom between an upper configuration wherein the claws are apart and a lower configuration wherein the claws are held close together, and further wherein said lid comprises a protuberance located on the lid that is adapted to be engaged between the claws in the closed configuration of the lid.

13. The container of claim 12, wherein the claws are attached to an abutment such that when the protuberance presses against said abutment, the claws are inserted between ramps adapted to force said claws toward each other.

14. The container claim 11, wherein said complementary attachment members are carried by the bistable pushbutton and the lid respectively.

15. The container of claim 10, wherein the holding device comprises at least one elastically deformable member disposed between the pivots of the double hinge.

16. The container of claim 1, wherein the links comprise rods, the ends of which are curved to enter bores defining the pivots.

17. The container of claim 1, wherein the links are rigid plates, the ends of which are rolled to define housings defining the pivots.

18. The container of claim 1, wherein the links are substantially the same length.

19. The container of claim 1, wherein the location of the fourth pivot is closer to the articulation area than the location of the second pivot.

20. The container of claim 1, wherein the upper link has an overall inclination of less than 20 degrees relative to a median plane of the lid in the closed configuration.

21. The container of claim 1, wherein the lower link has an overall inclination ranging from 20 degrees to 50 degrees relative to a median plane of the lid in the closed configuration.

22. The container of claim 1, wherein the pushbutton includes two bearing surfaces that are mobile relative to each other and are urged toward each other by at least one spring, wherein one of the bearing surfaces is fastened to a closed heart-shaped guide track, globally situated in a plane perpendicular to a median plane of the bottom, and wherein the other bearing surface comprises a follower finger adapted to follow said guide track during relative movements of said bearing surfaces.

23. The container of claim 1, wherein the pushbutton includes two bearing surfaces comprising two rings that are mobile relative to each other in rotation and in translation and that are urged toward each other by at least one spring, wherein one ring comprises radial projections pressed against an annular track fastened to the other ring, and further wherein said annular track is sawtooth-shaped and comprises hollows having at least two different depths.

24. The container of claim 1, further comprising:

only one pushbutton, and only one double hinge, wherein said pushbutton and said double hinge are located opposite each other relative to a central area of the container.

25. The container of claim 24, further comprising:

only one pushbutton and only one double hinge, wherein said body comprises the overall shape of a rectangle or a square, and further wherein said pushbutton and said hinge are disposed substantially in the middle of opposite sides of said rectangle or square.

26. The container of claim 1, wherein said container is a box and the first and third pivots are carried by a projection on the bottom of the body of the box.

* * * * *

UNITED STATES PATENT AND TRADEMARK OFFICE

CERTIFICATE OF CORRECTION

PATENT NO. : 8,261,934 B2
APPLICATION NO. : 12/527688
DATED : September 11, 2012
INVENTOR(S) : Christian Salciarini et al.

It is certified that error appears in the above-identified patent and that said Letters Patent is hereby corrected as shown below:

Title Page

"(73) Assignee: Channel Parfums Beaute, Neuilly-sur-Seine (FR)"

should be corrected to read:

--(73) Assignee: Chanel Parfums Beaute, Neuilly-sur-Seine (FR)--

Signed and Sealed this
Twenty-sixth Day of February, 2013

Teresa Stanek Rea
*Acting Director of the United States Patent and Trademark Office*